United States Patent [19]

Hiorth

[11] 4,191,480

[45] Mar. 4, 1980

[54] CONTINUOUS FLOW STATIC MIXER FOR MIXING POWDER AND/OR SUSPENSION MATERIALS WITH LIQUID MATERIALS

[75] Inventor: Hans Hiorth, Lierbyen, Norway

[73] Assignee: Dyno Industrier A.S, Oslo, Norway

[21] Appl. No.: 893,308

[22] Filed: Apr. 4, 1978

[30] Foreign Application Priority Data

Apr. 4, 1977 [NO] Norway ..... 771200

[51] Int. Cl.[2] ..... B01F 15/00

[52] U.S. Cl. ..... 366/336; 366/341; 138/42

[58] Field of Search ..... 366/336, 337, 338, 340, 366/341; 239/518, 521-524; 138/37, 40, 42, 44; 23/283-285; 123/119 R, 121, 127

[56] References Cited

U.S. PATENT DOCUMENTS

| | | | |
|---|---|---|---|
| 1,637,697 | 8/1927 | Jacobsen | 366/340 |
| 3,066,920 | 12/1962 | Prosser | 366/338 |
| 3,775,063 | 11/1973 | Grout et al. | 23/283 |
| 3,785,572 | 1/1974 | Arnold et al. | 239/518 |

*Primary Examiner*—Leonard D. Christian

*Attorney, Agent, or Firm*—Wenderoth, Lind & Ponack

[57] ABSTRACT

A static mixer for continuously mixing powder or suspension materials with liquid materials, especially explosive components, includes a toroidal mixing chamber having a central pipe nozzle inlet for pressurized powder/suspension material and annular conical slit-nozzles for pressurized liquid material. A conical spreader body arranged coaxially downstream of the central pipe nozzle inlet forms the powder/suspension jet from the pipe nozzle into a thin conical high speed spray that hits the thin conical high speed liquid spray from the conical split nozzles in a common circular unsupported or "floating" mixing zone.

6 Claims, 3 Drawing Figures

CONTINUOUS FLOW STATIC MIXER FOR MIXING POWDER AND/OR SUSPENSION MATERIALS WITH LIQUID MATERIALS

BACKGROUND OF THE INVENTION

The present invention relates to an apparatus for mixing one or more powder and/or suspension materials with one or more liquid materials. The apparatus is particularly developed for the continuous manufacture of explosives by effective intermixing of the components thereof.

The apparatus according to the invention belongs to the static mixer category, i.e. a mixer in which the mixing occurs in a continuous flow without any moving parts other than the materials themselves.

Several types of static mixers are already known. In one known mixer a powder component is conveyed as a uniform stream in a conduit or on a plane surface while the other components to be included in the mixed product are sprayed into or onto the first stream, normal thereto, for example through spreading nozzles.

A second mixer is based on an ejector system in which one of the components may be the central jet and a second component is entrained by suction from a surrounding annular chamber.

In a third known mixer the components are initially conveyed together in a pipe, as a non-mixed, laminar and parallel flow discharging into an apparatus in which the flow is subjected to strong turbulence by repeatedly forcing and dividing it through a plurality of irregular plate channels.

For several mixing purposes the above mentioned known mixers suffer from certain deficiencies. The two first mentioned mixers will produce a non-homogenous mixture because the mixing zone will be located substantially at the surface layer of the main-stream. Furthermore, particularly with regard to the third mixer, there will be a tendency of plugging of the apparatus in such cases where the mixture gradually attains a sticky consistency.

A better solution to the problem of plugging or lump formation is provided by the disclosure of British patent specification No. 1,388,767 (based on a Japanish priority application No. 54935/71). According to this patent one powder component is gravity fed through a vertical pipe discharging down onto a power driven, rotating spreader cone that centrifugally disperses the powder into a liquid film flowing down the inner surface of a surrounding inverted truncated cone. The resulting compound is then further mixed on an underlying pin plate that rotates with the spreader cone.

However, also in this last mentioned apparatus there will be a tendency of lumping where the powder impinges on the liquid film supported on the walls of the inverted cone, and besides the relatively low velocities of the meeting component streams are not sufficient to secure an effective mixing of the materials, thus necessitating the above mentioned power driven post mixing. Thus, the apparatus according to the above British patent is not a static mixer and therefore, for safety considerations, is undesirable in the manufacture of explosives. Furthermore the apparatus is limited to the simultaneous mixing of not more than two materials.

SUMMARY OF THE INVENTION

The object of the present invention is to provide a static mixer without the above described deficiencies in order to obtain a homogeneous mixture by momentary intermixing of the materials.

The mixer of the invention is also advantageous when more than two materials are to be intermixed and it is not limited to the production of explosive components.

Generally the mixer according to the invention will be useful for mixing purposes where intermixing of the materials results in a change of consistency that hampers the further treating process. Such changes may for example imply thickening, stickiness, gassing, temperature dependent variations of static, etc.

In particular the mixing of explosives calls for certain precautionary measures. Thus continuous processes with small amounts of explosive materials in the apparatus are generally preferred to batch mixtures, few or no moving machine parts are essential, and the mixing should take place with a minimum of power consumption and in a small and light apparatus.

The static mixer according to the invention comprises a toroidal mixing chamber, an inlet for each powder and/or suspension component centrally and coaxially disposed in the chamber and at least one spreader body having a substantially conical spreading surface centrally disposed and in a spaced and downstream relationship to the powder/suspension inlet(s), and a annular inlet in the chamber for each liquid component. The mixer is characterized by each powder/suspension inlet being in the form of a pipe nozzle communicating with a pressure vessel containing fluidized powder components and/or suspension components and by each liquid inlet being in the form of conical slit-nozzle communicating with a liquid-containing pressure vessel, and the spreading surfaces and the conical slit-nozzles being such axially and angularly disposed relative to each other that in operation of the mixer the high speed conical powder/suspension sprays leaving the conical spreading surfaces hit the high speed conical liquid streams from the conical slit-nozzles in a common unsupported or floating circular mixing zone in the mixing chamber.

BRIEF DESCRIPTION OF THE DRAWINGS

Various other objects and advantages of the present invention wil be readily apparent from the following description of the schematic drawings in which two exemplary embodiments of the invention are shown in connection with the mixing of explosives, and in which.

DETAILED DESCRIPTION OF THE INVENTION

Figure 1:
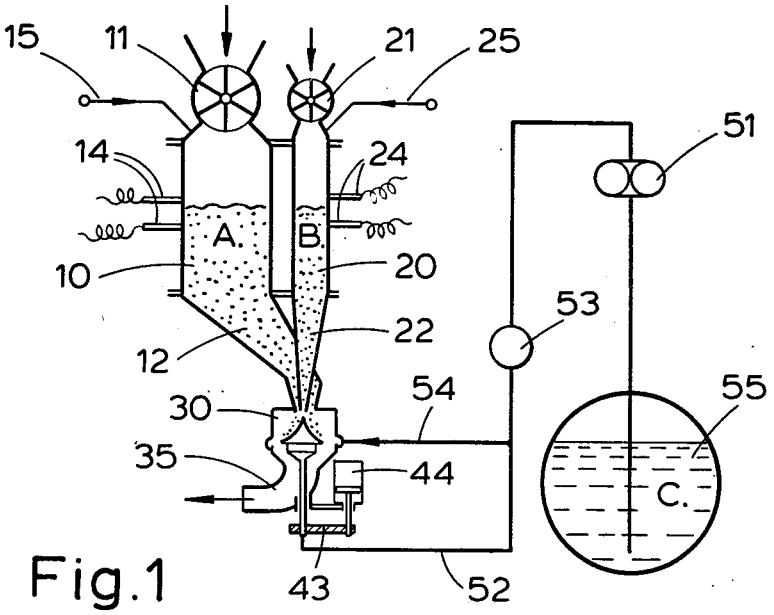
FIG. 1 is an elevational cross section of an embodiment of a mixer according to the invention for the simultaneous mixing of two powder components and one liquid component.

In FIG. 1 the numbers 10 and 20 are pressure vessels for two different powder components A and B respectively which are to be intermixed, and also mixed with a liquid component C which is stored in a tank 55. The ratio of the cross sectional area of the two pressure vessels 10 and 20 is preferably substantially the same as the desired mixture ratio of the powder components A and B. For example the apparatus may be used for mixing an explosive with the trade name "Anolit A" consisting of ammonium nitrate-prills and aluminum powder (powder components A and B respectively) and an oil mixture C, at a weight ration of about 91%, 5% and 4%, respectively.

On top of each pressure vessel 10 and 20 is sealingly mounted a combined cell feeder/air lock 11 and 21 respectively, for continuous introduction of the respective powder components, and conduits 15 and 25 respectively for controlled supply of compressed air are connected at the top of each vessel. Further, the vessels may be provided with means 14 and 24 respectively for control of the powder level in the vessels.

Figure 2:
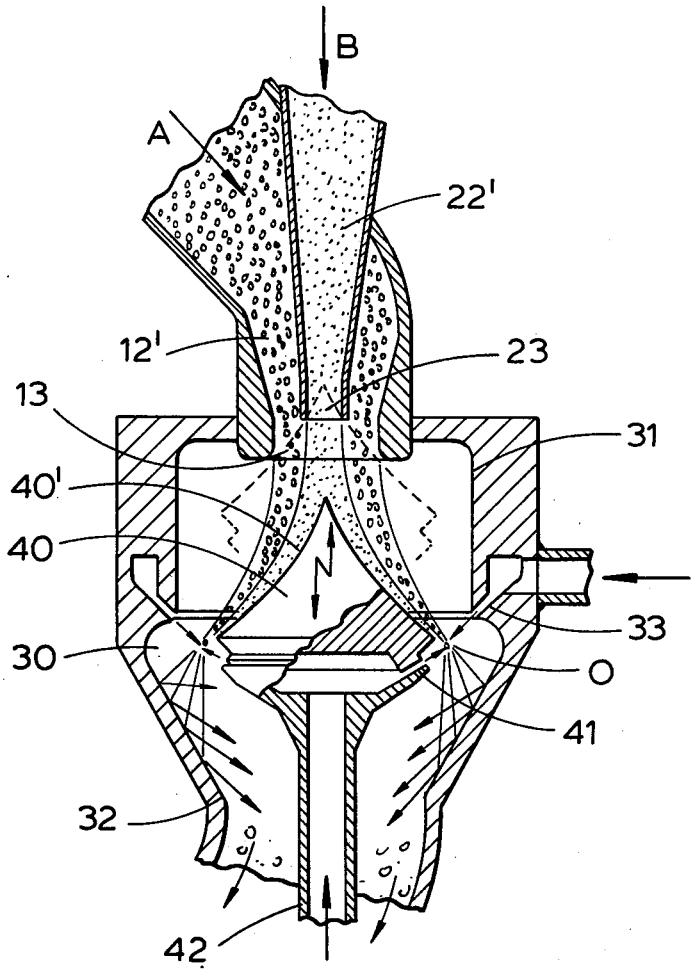
FIG. 2 is an enlarged fragmentary view in greater detail of the mixer of FIG. 1.

The vessels 10, 20 have open bottoms followed by respective hoppers 12 and 22. In the shown embodiment the hopper 12 of the one (largest) vessel 10 slopes toward the other hopper 22 from the smallest vessel 20, the end portion 22' (FIG. 2) of which is located concentrically in the end portion 12' of the former hopper 12. The inner 22' and outer 12' hopper end portions terminate in pipe-nozzles 23 and 13 respectively, the inner or central nozzle 23 terminating a short distance within the mouth of the outer nozzle 13.

The hopper or nozzle mouths 13, 23 open directly into a toroidal mixing chamber 30 comprising an upper cylindrical portion 31 and a lower bulbous portion 32 with substantially conically inclined lower walls. Circumferentially between the upper cylindrical portion 31 and the lower bulbous portion 32 an annular conically downwardly directed slit-nozzle 33 for a liquid component C opens into the mixing chamber.

In the mixing chamber 30, coaxially beneath the hopper openings 12, 23 a jet spreader body 40 having a downward diverging, preferably substantially cone shaped surface 40'. The cone surface 40' is preferably somewhat concave relative to a true cone surface. The spreader body 40 may be mounted on a pipe rod 42 which via a linkage 43 (FIG. 1) may be connected with displacing means 44, for example a pneumatic or hydraulic cylinder, for controlled movement of the spreader body in the axial direction. The distance between the two pipe-nozzles or hopper openings 13, 23 is preferably such that the cone surface 40' of the spreader body 40 in its upper position sealingly closes both nozzle openings, as indicated with broken lines in FIG. 2.

At its lower end the spreader body 40 has a reduced diameter portion with a second conically upwardly directed annular slit-nozzle 41 for liquid component C. The conical slit-nozzles 33, 41 for the liquid component have preferably substantially the same cone angle, and this angle is preferably such that the common cone plane of the conical slit-nozzles 33, 41 intersects the plane of the cone surface 40' of the spreader body substantially at an angle of 90°. The conical slit-nozzle 41 of the spreader body 40 communicates with the interior of the pipe rod 42, which in turn, via a supply conduit 52 and a proportioning pump 51, communicates with the liquid tank 55. The conical slit-nozzle 33 in the wall of the mixing chamber 30 communicates with a pipe section 54 to the same liquid supply from the tank 55.

In operation of the above described apparatus the powder components A and B are supplied in appropriate mixture proportions to the respective pressure vessels 10 and 20, by means of respective cell feeders/air locks 11 and 12 while at the same time compressed air is introduced such that the powder supplied to the vessels is fluidized and discharged as a high velocity jet out of their respective pipe-nozzles 13, 23 in the end of each hopper 12, 22. Thus, the fluidized powder component B will be ejected as a central jet surrounded by an annular jet of fluidized powder component A.

When the powder component jets meet the lower upwardly directed cone surface 40' of the spreader body 40 in the cylindrical opening portion 31 of the mixing chamber, they are forced outwardly along the cone surface into a lower and upper layer which are thinned out proportionally with increasing distance from the cone axis.

At the same time the liquid component C is pumped by means of proportioning pump 51 and a quantity regulator means 53 from the tank 55 to its respective conical annular slit-nozzles in the mixing chamber 30 and the spreader body 40 respectively, from which they flow out into the mixing chamber in a thin cone-shaped high velocity spray. The height of the spreader body 40 in the mixing chamber 30 is preferably adjusted in such a manner that the liquid sprays emerging from the slit-nozzles 33, 41 in the mixing chamber and spreader body respectively are directed directly against each other and hit the conical powder spray emerging from the lower edge of the cone surface 40' in a common, substantially circular, unsupported or "floating" mixing zone O in the free space between the cone edge and the mixing chamber walls. In this floating mixing zone an effective intermixing will take place between the two powder components A and B and the liquid component C. The liquid particles of the oppositely directed liquid sprays will be spread from each side on each single by-passing powder sphere from A and B, substantially in accordance with the given mixing ratio.

After intermixing in the mixing zone the hollow substantially cone shaped high velocity resultant spray will impinge against the inward sloping substantially conical walls of the lower mixing chamber portion 32 and rebound toward the center of the mixing chamber, to promote further mixing of the total mixture.

The mixed product is then, entrained in the air stream, discharged through an exit 35 in the lower part of the mixing chamber.

According to an advantageous feature of the apparatus the velocity imparted to the mixture leaving through the exit 35 will be sufficient to fill up a mining hole directly through a charging hose connected to the exit 35. Alternatively a special charging apparatus may be filled up by means of a short hose. When the above described mixing process is carried out in a factory the finished product may be loaded directly into so-called valve-bags without the need for an expensive fluidizing packer.

By the described arrangement in which the two powder components A and B flow through relatively large nozzle openings against a height-controllable spreader body the advantageous hollow cone shaped sprays of the powder components A and B are achieved without the risk of the nozzle openings being plugged by small lumps in the powder components. With sufficient air pressure in the vessels 10 and 20, for example 0.3–3 atm. and properly shaped nozzles 13 and 23 the hollow conical powder spray at the exit from the lower edge of the cone or spreading surface 40' may have a reduced thickness substantially equal to the diameter of the powder particles. As an example of practical use of the apparatus according to the invention about six tons hour were mixed in an apparatus having a spreader cone with a largest diameter of about 50 mm.

For the relatively easily flowing liquid component C where no risk of lump formation is present, the advantageous hollow cone sprays are most conveniently obtained by the above described conical slit-nozzles in the walls of the mixing chamber and spreader body.

Because the powder and liquid components meet in an unsupported mixing zone floating freely in space the tendency of lump formation will be greatly reduced, compared for example to the mixer of the above mentioned British Pat. No. 1,388,767 where the liquid stream is supported on a rigid cone surface. The high velocity of the component sprays further counteracts lumping, also when the resultant mixed spray impinges on the inclined walls of the lower mixing chamber portion 32. Contrary to the mixer of such British patent the longitudinal axis of the mixer need not be vertical, and may in fact be horizontally aligned if this is convenient for space considerations or other reasons.

Upon shutdown of the above described apparatus the liquid supplies to the mixing chamber 30 and the compressed air supply to the vessels 10 and 20 are simultaneously closed, and the cone spreader 40 is moved into its upper position in which the cone surface 40' sealingly closes the outlet nozzles 13 and 23.

Figure 3:
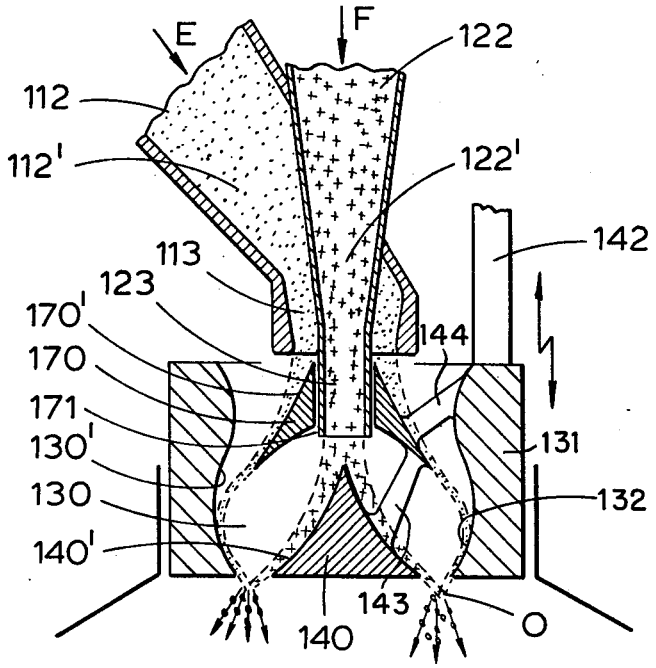
FIG. 3 is an enlarged fragmentary elevational cross section of another embodiment of the mixer according to the invention for the mixing of one powder component and one suspension component with at least one liquid component.

In FIG. 3 another embodiment of the apparatus according to the invention is shown, such apparatus being suitable for example for mixing a powder component and a suspension component with at least one liquid component.

For suspensions which include solid particles, because of the risk of plugging it is generally not possible to use an annular nozzle having a small slit opening.

The apparatus according to FIG. 3 comprises for the powder component substantially the same equipment as in the previously described embodiment, that is, although not shown, a pressure vessel for the powder component with a weight control supply through cell feeder/air lock, compressed air supply, level meter and outlet hopper 112.

For the suspension component, there is also provided a not shown pressure vessel or conduit in which the suspension preferably is mixed when introduced therein and the open bottom of which is followed by a tapering hopper 122 substantially corresponding to the hopper 22 of the previous example, the end portion 122' of the hopper 122 from the suspension vessel in the same manner being inserted centrally in the end portion 112' of the hopper 112 from the powder component, and both hopper ends discharging with nozzle openings 123 and 113 respectively into a mixing chamber 130.

Further, also in this case a spreader body 140 having a substantially cone shaped surface 140' is arranged in the mixing chamber 130 below the lower central hopper opening 123. However, this cone or spreader body 140 is not common for both hopper openings 113 and 123 such as in the previous example, as it serves only to spread out the suspension jet from the central nozzle opening 123. Coaxially and spaced above the spreader body 140 is arranged a further spreader body 170 with a substantially conical surface 170' directly below the upper annular nozzle opening 113 of the hopper 112 from the powder vessel, the central cylindrical end portion 122' extending with a small play through a central bore 171 in the spreader body 170.

In this embodiment the upper portion of the mixing chamber is defined by a ring member 131 which concentrically surrounds the spreader bodies 140 and 170 and is formed with a substantially spherical inner wall 132 which serves to deflect the cone spray from the upper spreader body 170 inwardly against the cone spray from the underlying spreader body 140. The two spreader bodies may be rigidly secured to each other and to the surrounding ring member 131, for example via bars 143 and 144, the three inter-connected parts 140, 170 and 131 preferably being adapted for common axial movement, for example by means of a rod 142 secured to the ring member 131, which rod in its turn may be connected to suitable displacing means, for example a pneumatic or hydraulic cylinder (not shown). The distance between the respective nozzles 113, 123 and between the respective spreader bodies 140, 170, and the general configuration of these parts are related in such a manner that the respective cone surfaces 140' and 170' close the respective nozzle outlets 123, 113 when the spreader bodies are in their upper extreme position.

In operation of the last described embodiment shown on FIG. 3, the powder component E, like in the previously described example, is led into a pressure vessel in which it is fluidized and blasted via the hopper 112 out through the outer relatively large nozzle 113. Here the powder stream meets the truncated spreader cone 170 and is forced outwardly into a hollow conical, gradually thinner stream along the cone surface 170'. From the lower edge of the spreader body the cone stream traverses the open space of the mixing chamber until it meets the spherical wall portion 132 of the mixing chamber where the cone stream is deflected and emitted as a spray inwardly toward the longitudinal axis of the mixing chamber. At the same time the suspension component F is supplied in a proportionally correct ratio to its pressure vessel, from which it is pressure fed through the hopper 122 and exits in the form of a jet from the nozzle opening 123 in the end of the hopper 122. Here the compact suspension jet meets the spreader cone 140 and is forced outwardly along its surface 140' in a stream of gradually reduced thickness until it leaves the cone edge in an outwardly directed cone spray and immediately thereafter hits the inwardly directed cone spray of the powder component E in a substantially circular unsupported or floating mixing zone O.

Also in this embodiment conical slit-nozzles for liquid components are contemplated in the mixing chamber and/or lower spreader cone walls. Although not shown they will be substantially similar to those illustrated and described in the previous example and produce high velocity liquid cone sprays that coincide with the powder/suspension sprays in the common, free mixing zone O. In this zone O an effective mixing of the respective components will take place. The resultant spray which after mixing may have a very sticky or adhesive consistency, may now immediately be passed into a post-mixing and screw-conveyor system able to handle plastic material.

Owing to the relatively large nozzle openings of the hopper ends, the above described embodiment of the invention also permits a high rate of product throughput irrespective of smaller lump formations or irrespective of highly viscous suspension, and the previously described advantages of a free mixing zone are maintained.

It will be readily appreciated from the above described examples of embodiments of the static mixer according to the invention, that pipe nozzles for powder and/or suspension components may be combined with conical slit-nozzles for liquid components in many different ways, without departing from the inventive idea. Furthermore several mixing units of the type here shown and described may be combined in series, such that groups of components may be added in subsequent steps.

I claim:

1. A static mixer for mixing in a continuous flow powder and/or suspension materials with liquid materials, and especially for intermixing the material components of an explosive, said mixer comprising a toroidal mixing chamber, an inlet for each powder and/or suspension component centrally and coaxially disposed in the chamber, at least one spreader body having a substantially conical spreading surface centrally disposed and in a spaced and downstream relationship to the powder/suspension inlet(s), an annular inlet in the chamber for each liquid component, each said powder/-suspension inlet being in the form of a pipe nozzle communicating with a pressure vessel containing fluidized powder components and/or suspension components, each said liquid inlet being in the form of an annular conical slit-nozzle communicating with a liquid-containing pressure vessel, each said conical spreading surface and each said conical slit-nozzle being so axially and angularly disposed relative to each other such that in operation of the mixer the high speed conical powder/suspension sprays leaving each said conical spreading surface hit the high speed conical liquid sprays from each said conical slit-nozzle in a common unsupported or floating circular mixing zone in said mixing chamber.

2. A static mixer according to claim 1, including a first said conical slit-nozzle opening conically radially inwardly and a second said conical slit-nozzle opening radially outwardly in the mixing chamber.

3. A static mixer according to claim 2, wherein said conical slit-nozzles are in a common conical plane extending substantially normal to the plane of said spreading cone surface.

4. A static mixer according to claim 3, including a first central said powder/suspension pipe inlet nozzle, a second said powder/suspension pipe inlet nozzle coaxially surrounding said first central pipe inlet nozzle, a first said conical spreading surface axially spaced downstream of said first central pipe inlet nozzle, a second said conical spreading surface axially spaced downstream of said second pipe inlet nozzle and upstream relative to said first spreading surface, and a substantially spherical surface surrounding said first and second surfaces in a spaced relationship thereto, said spherical surface serving to deflect the radially outwardly flowing jet spray ejected from said second spreading surface radially inwardly to intersect the radially outwardly flowing jet spray ejected from said first spreading surface in a circular floating mixing zone.

5. A static mixer according to any one of the preceding claims, wherein said spreading surfaces are axially adjustable and adapted to sealingly close said pipe nozzle(s) in an extreme position of said surfaces.

6. A static mixer according to claim 2, wherein said conical radially inwardly opening slit-nozzle is located in said mixer chamber wall and said conical radially outwardly opening slit-nozzle is located in a central said spreader body carrying said conical spreading surfaces.

* * * * *